US007619174B2

(12) United States Patent
Uenomachi et al.

(10) Patent No.: US 7,619,174 B2
(45) Date of Patent: Nov. 17, 2009

(54) ILLUMINATED SWITCH DEVICE

(75) Inventors: Takashi Uenomachi, Miyagi-ken (JP); Fumihiko Kashiwabara, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 12/245,328

(22) Filed: Oct. 3, 2008

(65) Prior Publication Data

US 2009/0114514 A1 May 7, 2009

(30) Foreign Application Priority Data

Nov. 1, 2007 (JP) ..... 2007-285183

(51) Int. Cl.
*H01H 9/18* (2006.01)

(52) U.S. Cl. ..... 200/310; 200/314

(58) Field of Classification Search ..... 200/310–317; 341/22, 23, 28; 345/168–170
See application file for complete search history.

(56) References Cited

U.S. PATENT DOCUMENTS 3,639,745 A * 2/1972 Shiki ..... 200/311
4,301,344 A * 11/1981 Sakakino et al. ..... 200/314
5,252,798 A * 10/1993 Kamada ..... 200/314
5,581,251 A * 12/1996 McRight et al. ..... 341/22
5,659,297 A * 8/1997 Tatavoosian ..... 340/815.4
6,207,913 B1 * 3/2001 Nakajima et al. ..... 200/314
6,210,010 B1 * 4/2001 Pontetti et al. ..... 362/24
6,531,952 B1 * 3/2003 Meyer et al. ..... 338/172
6,667,451 B1 * 12/2003 Hart ..... 200/314
6,998,554 B2 * 2/2006 Shimoda et al. ..... 200/341
7,122,756 B2 * 10/2006 Sasaki et al. ..... 200/520
7,265,307 B2 * 9/2007 Miyasaka et al. ..... 200/314
7,545,364 B2 * 6/2009 Krzyzanowski et al. ..... 345/170

FOREIGN PATENT DOCUMENTS

JP 9-231855 9/1997

* cited by examiner

*Primary Examiner*—Michael A Friedhofer
(74) *Attorney, Agent, or Firm*—Brinks Hofer Gilson & Lione

(57) ABSTRACT

An illuminated switch device includes: a casing with an open upper side that has a partition wall formed on the inner bottom thereof; light sources that are provided on the inner bottom in a plurality of regions partitioned by the partition wall; an operating body that includes an outer housing and a light-shielding wall which divides a space surrounded by the outer housing and covered with an upper plate into a plurality of small spaces; and a switch element that is driven when the operating body is pressed. Guide rails are slidably fitted to concave grooves to guide the movement of the outer housing in the vertical direction. Both ends of the light-shielding wall 9 extending to the outside of the outer housing 8 serve as the guide rails.

2 Claims, 5 Drawing Sheets

ILLUMINATED SWITCH DEVICE

CLAIM OF PRIORITY

This application claims benefit of the Japanese Patent Application No. 2007-285183 filed on Nov. 1, 2007, the entire contents which are hereby incorporated by reference.

BACKGROUND

1. Technical Field

The present invention relates to an illuminated switch device in which an operating body is inserted into a casing having a plurality of light sources provided therein such that it can move in the vertical direction and light components emitted from the light sources are individually incident on a plurality of illuminated regions that are provided on an upper plate of the operating body, and more particularly, to a technique capable of preventing the leakage of light.

2. Related Art

The general structure of this type of illuminated switch device will be described below. A casing with an open upper end is provided on a substrate, and a partition wall integrally formed with the casing is provided on the inner bottom of the casing. Light sources, such as LEDs, are provided in a plurality of regions of the substrate that are partitioned by the partition wall. In addition, a plurality of illuminated regions on which light components emitted from the light sources are individually incident are provided on the upper plate of an operating body, and an outer housing that extends downward from the upper plate is inserted into the casing so as to be movable in the vertical direction. In this way, the operating body can be pressed against the casing. Further, in the operating body, a light-shielding wall that divides a space surrounded by the outer housing into small spaces corresponding to the illuminated regions is provided on the rear surface of the upper plate, and a partition portion is formed in the casing by the light-shielding wall and the partition wall. Therefore, light emitted from the light source that is provided in one of the illuminated regions partitioned by the partition wall is prevented from reaching the other illuminated region. In addition, a switch element, such as a push switch, is provided on the substrate inside or outside the casing. When the operating body is pressed, the switch element is turned on.

In the illuminated switch device having the above-mentioned structure, guide rails and concave grooves are provided at proper positions of the outer housing of the operating body and the inner wall surface of the casing as guide mechanisms for smoothly moving the operating body in the vertical direction. A technique for slidably fitting the guide rails into the concave grooves has been proposed (for example, see JP-A-9-231855).

FIG. 7 is a plan view illustrating the related art, in which the upper plate of an operating body is omitted. In the illuminated switch device shown in FIG. 7, a first light source 31 and a second light source 32 are provided on a substrate 40 of a casing 30, and regions for the light sources 31 and 32 are partitioned by a partition wall 33 that is provided on the inner bottom of the casing 30. An open end 30*a* is provided at the top of the casing 30, and concave grooves 34 are provided at four positions in the inner wall surface of the casing 30 so as to extend in the vertical direction (the direction that is perpendicular to the plane of the drawing). An outer housing 35 of an operating body, which is pressed, has substantially the same outer shape as the open end 30*a* of the casing 30 in plan view. The outer housing 35 is inserted into the casing 30 so as to be movable in the vertical direction. Guide rails 36, which extend in the vertical direction, protrude from the outer housing 35 at positions corresponding to the concave grooves 34. The guide rails 36 are slidably fitted into the corresponding concave grooves 34. In addition, the operating body is provided with a light-shielding wall 37 that divides a space surrounded by the outer housing 35 into a first small space 38 and a second small space 39. The light-shielding wall 37 is provided immediately above the partition wall 33. One of the illuminated regions provided on the upper plate (not shown) of the operating body is opposite to the first light source 31 through the first small space 38, and the other illuminated region is opposite to the second light source 32 through the second small space 39. The first and second small spaces 38 and 39 are closed by the upper plate. Since the light-shielding wall 37 and the partition wall 33 form a partition portion in the casing 30, light emitted from the first light source 31 is shielded by the partition portion such that it does not enter the second small space 39. Similarly, light emitted from the second light source 32 is shielded by the partition portion such that it does not enter the first small space 38.

In the illuminated switch device having the above-mentioned structure, a predetermined gap C is ensured between the outer housing 35 of the operating body and the inner wall surface of the casing 30. However, since the guide rails 36 provided on the outer housing 35 of the operating body are slidably fitted into the concave grooves 34 provided in the casing 30, it is possible to move the guide rails 36 substantially in the vertical direction. In addition, since the guide rails 36 are provided at the edge of the outer housing 35 at four positions with a good balance, it is possible to prevent the outer housing 35 from being inclined. Therefore, it is possible to smoothly move the operating body in the vertical direction.

However, in the illuminated switch device according to the related art shown in FIG. 7, the course of light leaking from the light sources 31 and 32 to the gap C between the outer housing 35 of the operating body and the inner wall surface and the casing 30 is not particularly considered. Therefore, light leaking to the gap C is likely to reach the edge of the open end 30*a* through the upper parts of both ends of the partition wall 33 (both ends in the vertical direction in FIG. 7). For example, light is emitted to the illuminated region immediately above the first small space 38. Therefore, when only the first light source 31 is turned on, light emitted from the first light source 31 in the direction of an arrow A in FIG. 7 reaches portions B of the gap C through the upper parts of both ends of the partition wall 33 where the light-shielding wall 37 or the outer housing 35 is not provided. As a result, although the illuminated region immediately above the second small space 39 is not illuminated, light leaks from around the illuminated region. In particular, light leaks from the second small space in a dark place, which results in significant deterioration of lighting quality.

SUMMARY

According to an aspect of the invention, an illuminated switch device includes: a casing with an open upper side that has a partition wall formed on the inner bottom thereof; light sources that are provided on the inner bottom in a plurality of regions partitioned by the partition wall; an operating body that is pressed and includes an outer housing and a light-shielding wall which divides a space surrounded by the outer housing and covered with an upper plate into a plurality of small spaces; a switch element that is driven when the operating body is pressed; guide rails that are provided in one of the casing and the outer housing so as to extend in the vertical direction; concave grooves that are provided in the other so as to extend in the vertical direction; a partition portion that is formed by the light-shielding wall and the partition wall in the casing; and a plurality of illuminated regions which are provided on the upper plate. The guide rails are slidably fitted to the concave grooves to guide the movement of the operating body in the vertical direction, light emitted from the light sources are individually incident on the plurality of illuminated regions through the small spaces, and each of the guide rails is arranged such that at least a portion thereof overlaps an extension of the light-shielding wall.

In the illuminated switch device having the above-mentioned structure, among light components leaking from the light sources to the gap between the outer housing of the operating body and the inner wall surface of the casing, even when a light component leaking to both ends of the partition wall passes through the upper part of the partition wall, the light component is shielded by the guide rails or the wall surfaces of the concave grooves. Therefore, it is possible to prevent light emitted from the light source from reaching the edge of the open end of the casing through the upper parts of both ends of the partition wall. That is, it is possible to effectively prevent light emitted from the light source from leaking from the edges of the illuminated regions. Therefore, in the illuminated switch device, since the guide rails extending in the vertical direction are slidably fitted into the concave grooves extending in the vertical direction, it is possible to smoothly move the operating body in the vertical direction.

In the illuminated switch device according to the above-mentioned aspect, preferably, the switch element is provided on the inner bottom of the casing, and a driving portion that presses the switch element is integrally formed with the outer housing of the operating body. According to this structure, it is possible to reduce the overall size of the device and simplify the structure of the device. However, the switch element may be provided outside the casing, or the operating body may press the switch element through a separate member.

According to the illuminated switch device of the above-mentioned aspect, even when light emitted from the light source to both ends of the partition wall of the casing passes through the upper part of the partition wall, the light is shielded by the guide rails or the wall surfaces of the concave grooves. Therefore, it is possible to prevent light emitted from the light source from reaching the edge of the open end of the casing through the upper part of the partition wall. That is, it is possible to effectively prevent light emitted from the light source from leaking from the edges of the illuminated regions. Therefore, it is possible to improve lighting quality. In addition, in the illuminated switch device, since the guide rails extending in the vertical direction are slidably fitted into the concave grooves extending in the vertical direction, it is possible to smoothly move the operating body in the vertical direction.

DESCRIPTION OF EXEMPLARY EMBODIMENTS

Figure 1:
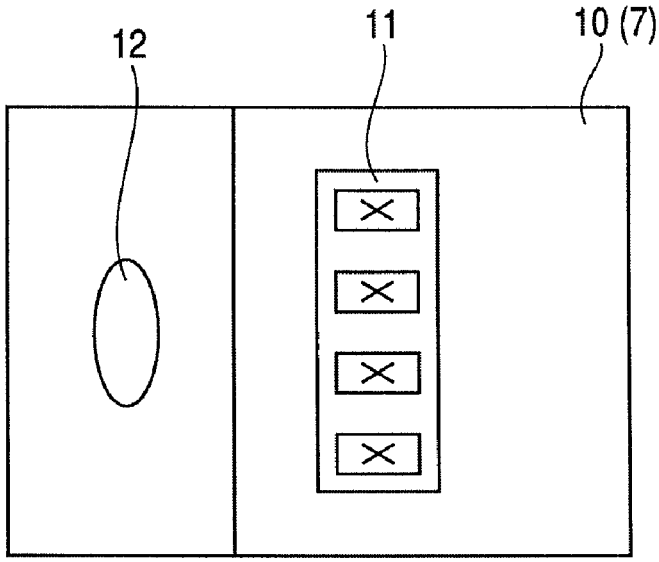
FIG. 1 is a plan view illustrating an illuminated switch device according to a first embodiment of the invention.
Figure 2:
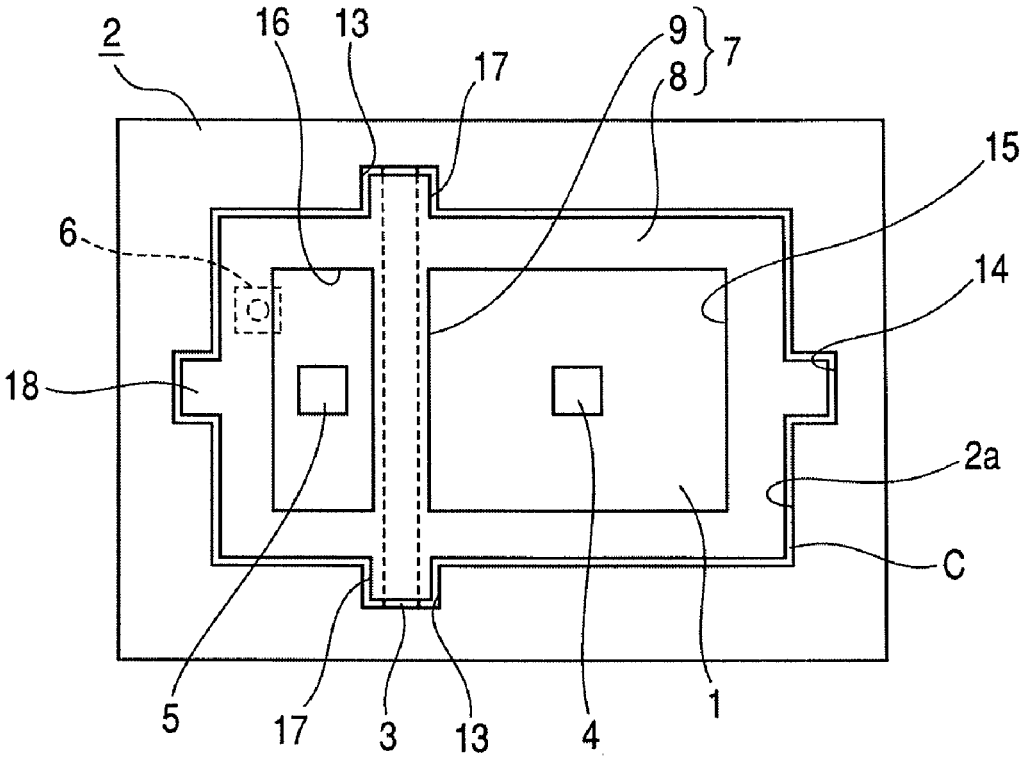
FIG. 2 is a plan view illustrating the internal structure of the switch device, in which an upper plate shown in FIG. 1 is omitted.
Figure 3:
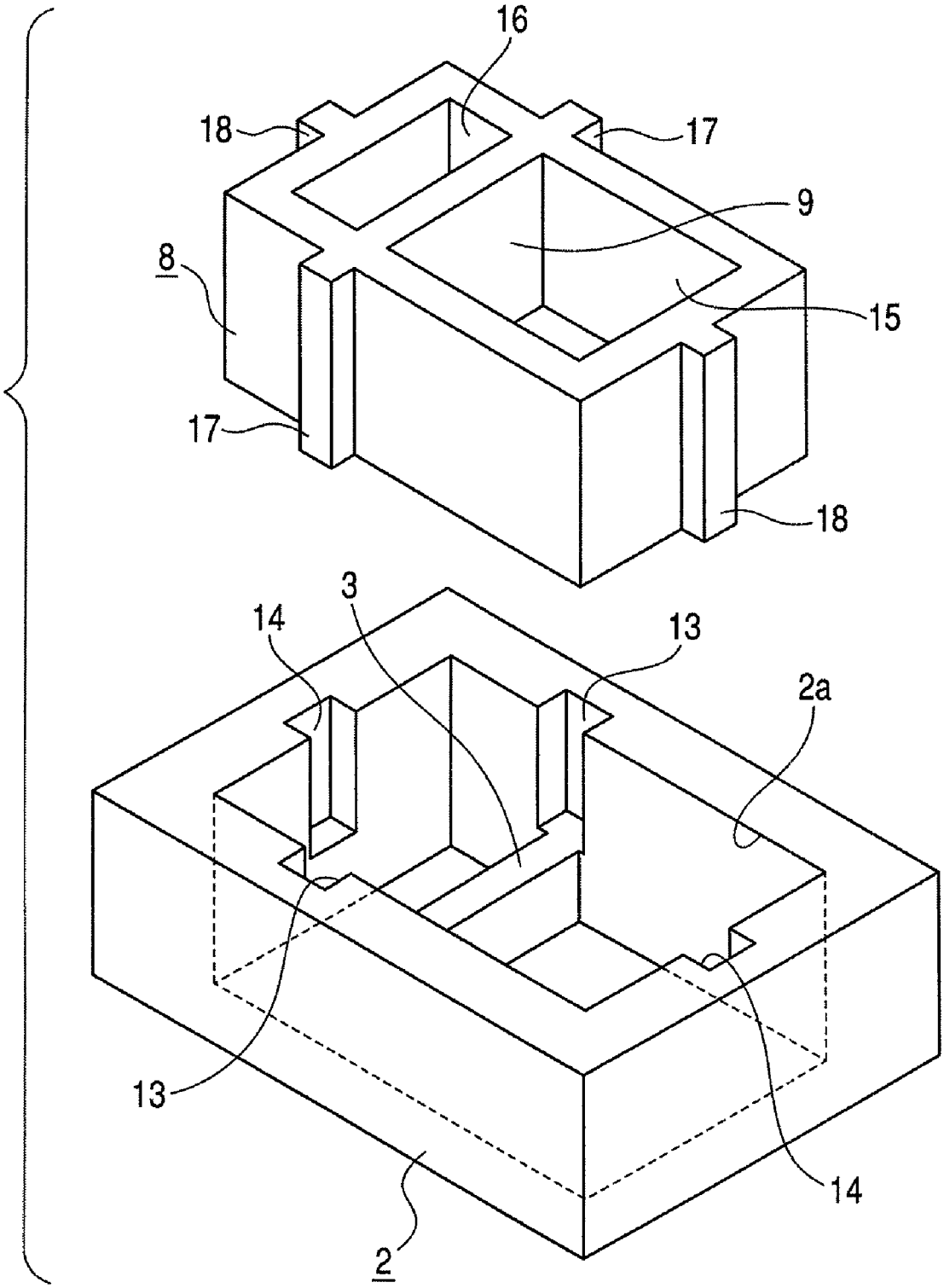
FIG. 3 is a perspective view illustrating an operating body and a casing of the switch device shown in FIG. 2.

Hereinafter, exemplary embodiments of the invention will be described with reference to the accompanying drawings. FIG. 1 is a plan view illustrating an illuminated switch device according to a first embodiment of the invention. FIG. 2 is a plan view illustrating the internal structure of the switch device. FIG. 3 is a perspective view illustrating an operating body and a casing of the switch device. However, in FIGS. 2 and 3, an upper plate of the operating body is omitted.

The illuminated switch device shown in FIGS. 1 to 3 includes: a casing 2 that has a partition wall 3 provided therein and is vertically provided on a substrate 1; a first light source 4, a second light source 5, and a push switch 6 that are provided on the substrate 1 in the casing 2; and an operating body 7 formed by attaching an upper plate 10 to a mold including an outer housing 8 and a light-shielding wall 9. A first illuminated region 11 for displaying characters and a second illuminated region 12 for an indicator are provided on the upper plate 10 of the operating body 7.

An open end 2*a* is formed at an upper part of the casing 2, and a partition wall 3 is formed on the inner bottom of the casing 2 with a predetermined height to partition the inside of the casing into regions for the light sources 4 and 5. A pair of concave grooves 13 are formed in the inner wall surface of the casing 2 that is continuous to the upper surfaces of both ends of the partition wall 3 so as to extend in the vertical direction to be connected to portions of the long sides of the open end 2*a*. In addition, a pair of concave grooves 14 are formed in the inner wall surface of the casing 2 so as to extend in the vertical direction to be connected to the centers of the short sides of the open end 2*a*.

In the operating body 7, a space surrounded by the outer housing 8 is covered with the upper plate 10, and the space is divided into a first small space 15 and a second small space 16 by the light-shielding wall 9. The outer shape of the outer housing 8 is substantially the same as that of the open end 2*a* of the casing 2 in plan view, and the outer housing 8 is inserted in the casing 2 so as to be movable in the vertical direction. Guide rails 17 and 18 that extend in the vertical direction protrude from the outer housing 8 at four positions corresponding to the concave grooves 13 and 14 of the casing 2. The guide rails 17 are slidably fitted into the corresponding concave grooves 13, and the guide rails 18 are slidably fitted into the corresponding concave grooves 14. The light-shielding wall 9 is provided immediately above the partition wall 3 of the casing 2, and both ends of the light-shielding wall 9 that protrude to the outside of the outer housing 8 serve as the guide rails 17. In addition, the light-shielding wall 9 is provided such that its lower end portion overlaps an upper end portion of the partition wall 3. Therefore, a partition portion is formed in the casing 2 by the light-shielding wall 9 and the partition wall 3. The first illuminated region 11 formed in the upper plate 10 is opposite to the first light source 4 through the first small space 15, and the second illuminated region 12 is opposite to the second light source 5 through the second small space 16. However, since the partition portion formed by the light-shielding wall 9 and the partition wall 3 is provided in the casing 2, light emitted from the first light source 4 is shielded by the partition portion and does not travel into the second small space 16. Similarly, light emitted from the second light source 5 is shielded by the partition portion and does not travel into the first small space 15.

A driving portion (not shown) is provided at the lower end portion of the outer housing 8 of the operating body 7 so as to protrude toward the push switch 6. When the operating body 7 is pressed, the push switch 6 is pressed by the driving portion. When the pressing force against the operating body 7 is removed after the pressing operation, the operating body 7 returns to its initial position by the elastic force of a return spring (not shown).

In the illuminated switch device having the above-mentioned structure, a predetermined gap C is ensured between the outer housing 8 of the operating body 7 and the inner wall surface of the casing 2. However, since the guide rails 17 and 18 provided on the outer housing 8 of the operating body 7 are slidably fitted into the concave grooves 13 and 14 provided in the inner wall surface of the casing 2, it is possible to move the guide rails 17 and 18 substantially in the vertical direction. In addition, since the guide rails 17 and 18 are provided at the edge of the outer housing 2 at four positions with a relatively good balance, it is possible to prevent the outer housing 2 from being inclined. Therefore, it is possible to smoothly move the operating body 7 in the vertical direction.

Further, in the illuminated switch device according to this embodiment, even when light emitted from the first light source 4 or the second light source 5 to the gap C in the vicinities of both ends of the partition wall 3 travels to the upper side of the partition wall 3, the light is shielded by the guide rails 17 or the wall surfaces of the concave grooves 13. Therefore, it is possible to prevent light emitted from the light sources 4 and 5 from leaking from the gap C and then reaching the edge of the open end 2*a* of the casing 2 through the upper side of the partition wall 3. That is, it is possible to effectively prevent light emitted from the light source from leaking from the edge of the first illuminated region 11 or the second illuminated region 12. Therefore, according to the illuminated switch device of this embodiment, it is possible to prevent light leakage in a dark place and thus obtain a good lighting quality.

In the first embodiment, the operating body 7 is formed by attaching the upper plate 10 to a mold including the outer housing 8 and the light-shielding wall 9. Therefore, it is possible to easily correspond to various types of operating bodies 7 with different purposes by covering the first illuminated region 11 for displaying characters with different types of upper plates 10. However, this invention is not limited thereto. The outer housing 8, the light-shielding wall 9, and the upper plate 10 may be integrally formed to manufacture the operating body 7. In addition, a casing 2 with the bottom having connection terminals for an external circuit formed thereon may be used, and the light sources 4 and 5 and the push switch 6 may be provided on the inner bottom of the casing 2.

Figure 4:
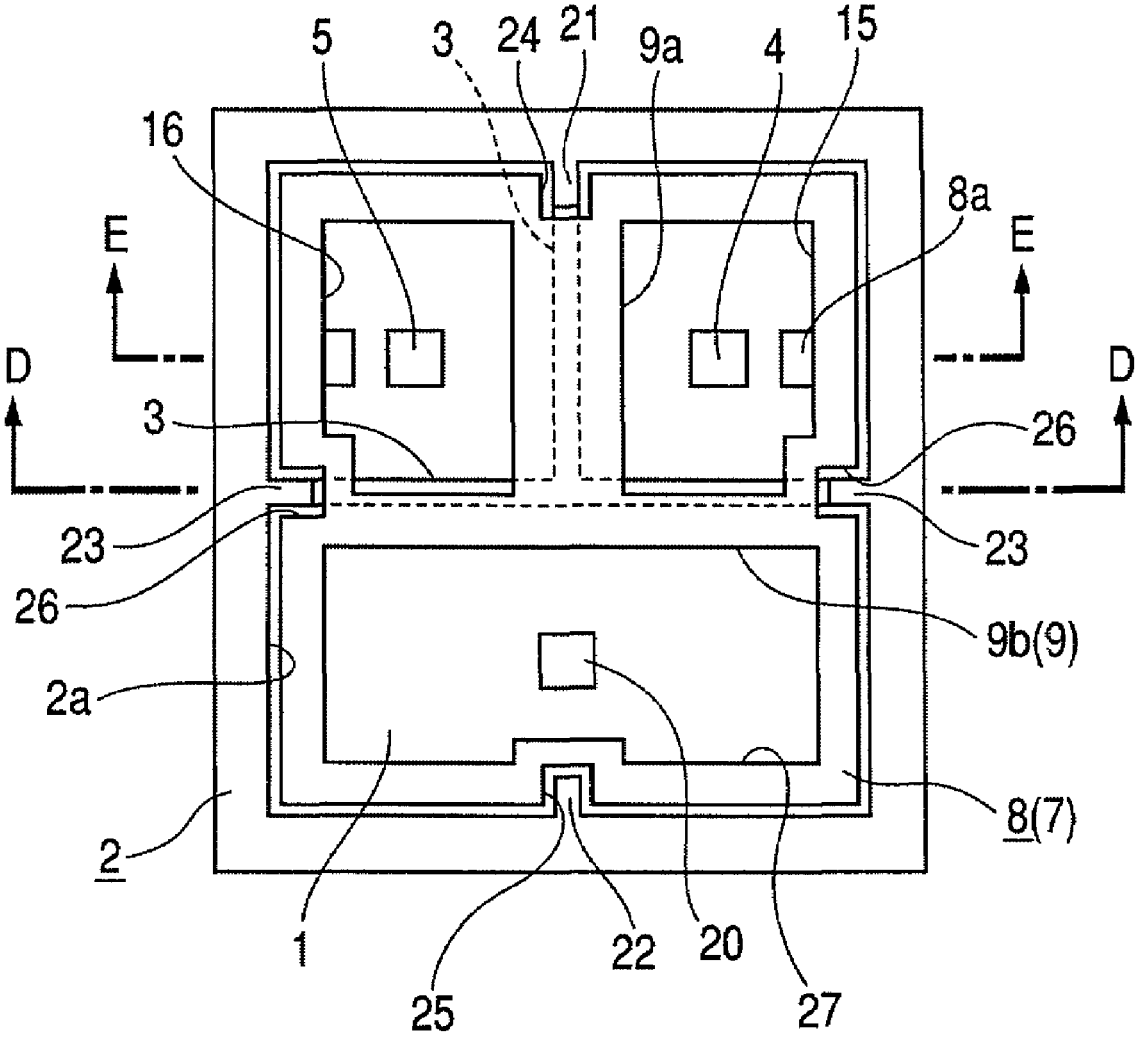
FIG. 4 is a plan view illustrating the internal structure of an illuminated switch device according to a second embodiment of the invention.
Figure 5:
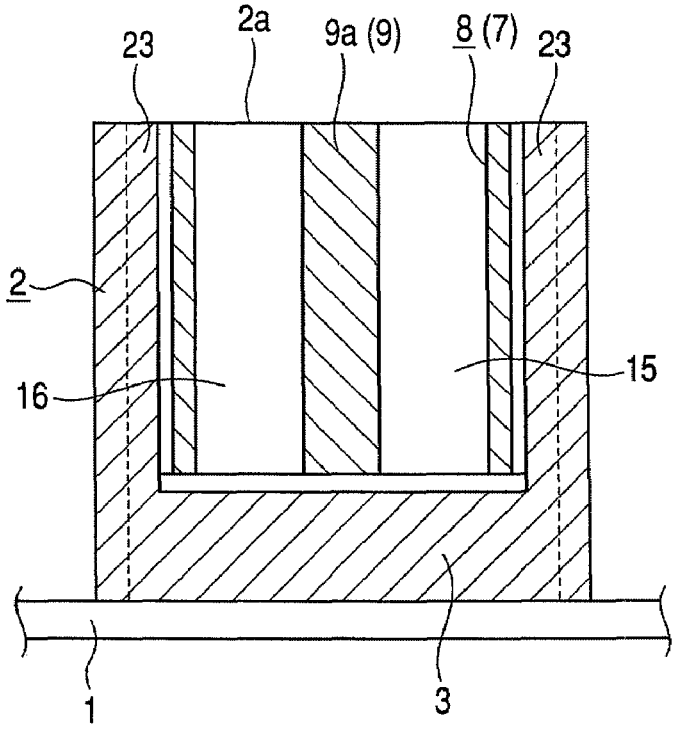
FIG. 5 is a cross-sectional view taken along the line V-V of FIG. 4.
Figure 6:
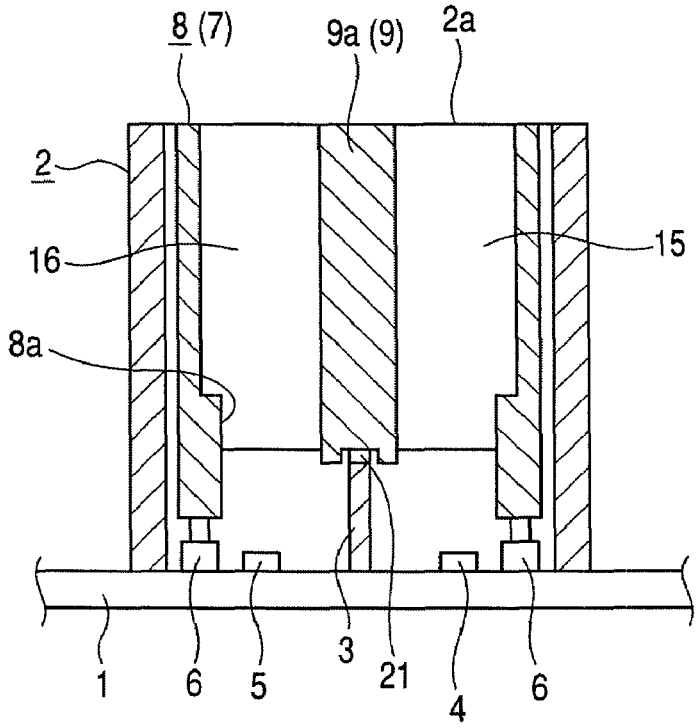
FIG. 6 is a cross-sectional view taken along the line VI-VI of FIG. 4.
Figure 7:
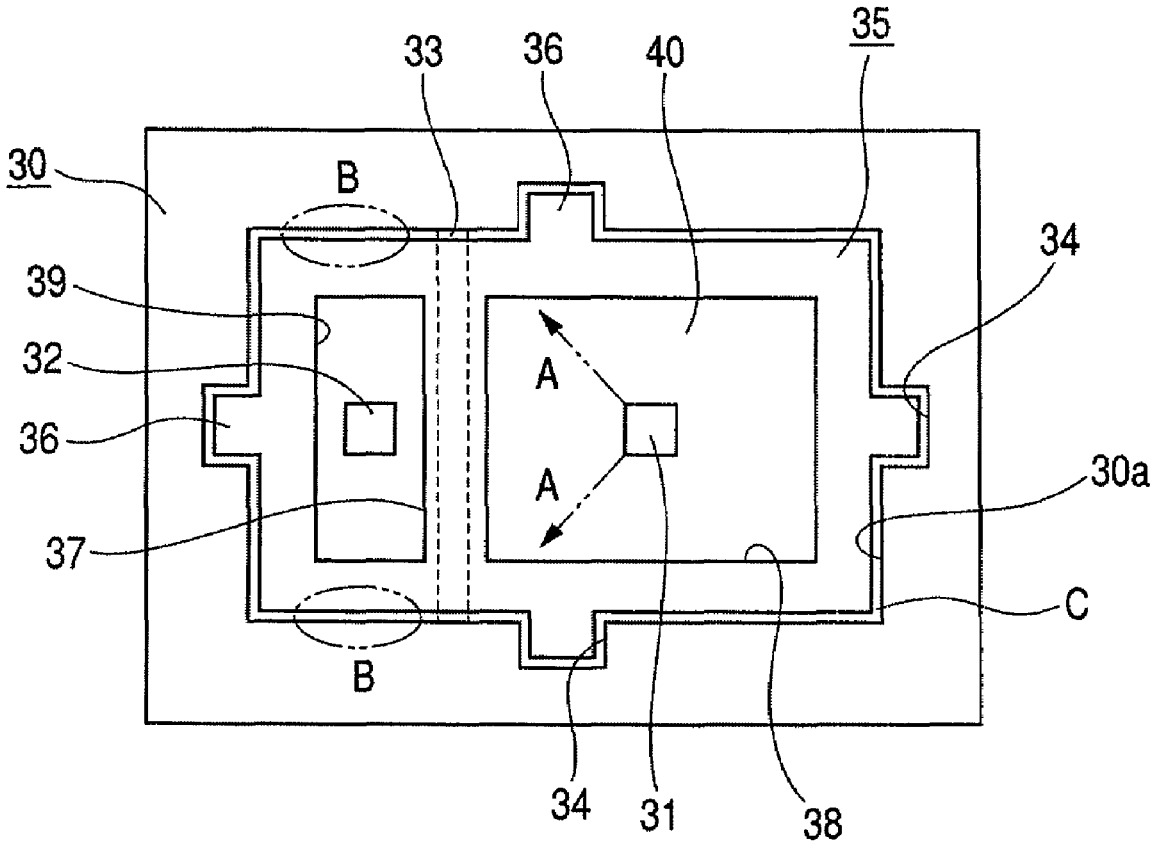
FIG. 7 PRIOR ART
FIG. 7 is a diagram illustrating the internal structure of an illuminated switch device according to the related art.

FIG. 4 is a plan view illustrating the internal structure of an illuminated switch device according to a second embodiment of the invention, and FIG. 5 is a cross-sectional view taken along the line V-V of FIG. 4. FIG. 6 is a cross-sectional view taken along the line VI-VI of FIG. 4. In this second embodiment, the same components as those shown in FIGS. 1 to 3 are denoted by the same reference numerals, and a description thereof will be omitted for clarity of description. In addition, in FIGS. 4 to 6, an upper plate of an operating body is omitted.

In the illuminated switch device shown in FIGS. 4 to 6, first to third illuminated regions (not shown) are provided in the upper plate of the operating body 7, and light components are individually emitted from three light sources 4, 5, and 20 provided in the casing 2 to the illuminated regions. The open end 2*a* of the casing 2 has a substantially square shape, and the guide rails 21 and 22 and a pair of guide rails 23 protrude from the inner wall surface of the casing 2 at the centers of four sides of the open end 2*a* so as to extend in the vertical direction. The concave grooves 24 and 25 and a pair of concave grooves 26 that extend in the vertical direction are provided in the outer housing 8 of the operating body 7 at four positions that correspond to the guide rails 21 to 23. The concave grooves 24 to 26 slide on the corresponding guide rails 21 to 23 such that the outer housing 8 is moved relative to the casing 2 in the vertical direction.

A partition wall 3 having a substantially T shape in plan view is provided on the inner bottom of the casing 2, and a shielding wall 9 having a substantially T shape in plan view is provided in the operating body 7 so as to be opposite to the partition wall 3. A space surrounded by the outer housing 8 of the operating body 7 is divided into first to third small spaces 15, 16, and 27 by the light-shielding wall 9, and the illuminated regions provided on the upper plate of the operating body 7 are opposite to the light sources 4, 5, and 20 through the small spaces 15, 16, and 27, respectively. The light-shielding wall 9 includes a wide wall portion 9*a* and a narrow wall portion 9*b*. One side of the wide wall portion 9*a* is connected to the center of the narrow wall portion 9*b*. Therefore, a concave groove 24 is formed in the outer housing 8 between the other side of the wide wall portion 9*a* and the inner wall surface of the casing 2, and the concave groove 24 is slidably fitted to the guide rail 21.

In addition, concave grooves 26 are formed in the outer housing 8 between both sides of the narrow wall portion 9*b* and the inner wall surface of the casing 2, and the concave grooves 26 are slidably fitted to the guide rails 23. That is, a portion of each of the guide rails 23 is arranged so as to overlap an extension of the narrow wall portion 9*b*. In addition, a concave groove 25 is provided in the outer housing 8 at a position that is symmetric with respect to the concave groove 24, and the concave groove 25 is slidably fitted to the guide rail 22. As shown in FIG. 6, driving portions 8*a* that press the push switches 6 are provided on the outer housing 8 so as to protrude downward.

In the illuminated switch device according to this embodiment, the concave grooves 24 to 26 provided in the outer housing 8 slide on the guide rails 21 to 23 provided on the inner wall surface of the casing 2 to guide the movement of the operating body 7 in the vertical direction. This embodiment differs from the first embodiment in that the positional relationship between the concave and convex portions of the guide mechanism is reversed. However, any positional relationship between the concave and convex portions of the guide mechanism may be used to smoothly move the operating body 7 in the vertical direction.

In this embodiment, even when light emitted from the first light source 4 or the second light source 5 to the vicinity of the lower end portion of the concave groove 24 travels to the upper side of the partition wall 3, the light is shielded by the guide rail 21 or the wall surface of the concave groove 24. Therefore, it is possible to prevent light emitted from the light sources 4 and 5 from leaking from around the lower end portion of the concave portion 24 and then reaching the edge of the open end 2*a* of the casing 2 through the upper side of the partition wall 3. Similarly, even when light emitted from the light sources 4 and 5 or the light source 20 to the vicinity of the lower end portion of the concave groove 26 travels to the upper side of the partition wall 3, the light is shielded by the guide rail 23 or the wall surface of the concave groove 26. Therefore, it is possible to prevent light emitted from the light sources 4, 5, and 20 from leaking from around the lower end portion of the concave portion 26 and then reaching the edge of the open end 2*a* of the casing 2 through the upper side of the partition wall 3. As a result, it is possible to effectively prevent light emitted from the light source from leaking from the edge of each of the illuminated regions and thus improve lighting quality.

What is claimed is:

1. An illuminated switch device comprising:

a casing with an open upper side that has a partition wall formed on the inner bottom thereof;

light sources that are provided on the inner bottom in a plurality of regions partitioned by the partition wall;

an operating body that is pressed and includes an outer housing and a light-shielding wall which divides a space surrounded by the outer housing and covered with an upper plate into a plurality of small spaces;

a switch element that is driven when the operating body is pressed;

guide rails that are provided in one of the casing and the outer housing so as to extend in the vertical direction;

concave grooves that are provided in the other so as to extend in the vertical direction;

a partition portion that is formed by the light-shielding wall and the partition wall in the casing; and a plurality of illuminated regions which are provided on the upper plate, wherein the guide rails are slidably fitted to the concave grooves to guide the movement of the operating body in the vertical direction, light emitted from the light sources are individually incident on the plurality of illuminated regions through the small spaces, and each of the guide rails is arranged such that at least a portion thereof overlaps an extension of the light-shielding wall.

2. The illuminated switch device according to claim 1, wherein the switch element is provided on the inner bottom of the casing, and a driving portion that presses the switch element is integrally formed with the outer housing.

* * * * *